US006168506B1

(12) United States Patent
McJunken

(10) Patent No.: US 6,168,506 B1
(45) Date of Patent: Jan. 2, 2001

(54) APPARATUS FOR POLISHING USING IMPROVED PLATE SUPPORTS

(75) Inventor: Bob McJunken, Chandler, AZ (US)

(73) Assignee: SpeedFam-IPEC Corporation, Chandler, AZ (US)

( * ) Notice: Under 35 U.S.C. 154(b), the term of this patent shall be extended for 0 days.

(21) Appl. No.: 09/010,008

(22) Filed: Jan. 21, 1998

(51) Int. Cl.[7] ..... B24B 7/00; B24B 41/00

(52) U.S. Cl. ..... 451/259; 451/262; 451/269; 451/342; 451/343

(58) Field of Search ..... 451/262, 263, 451/264, 265, 266, 267, 268, 269, 340, 342, 343, 259

(56) References Cited

U.S. PATENT DOCUMENTS

| | | | | |
|---|---|---|---|---|
| 240,966 | * | 5/1881 | Chappell | 425/332 |
| 1,509,823 | * | 9/1924 | Blood | 451/262 X |
| 1,838,553 | * | 12/1931 | Kadow et al. | 451/265 |
| 1,949,514 | * | 3/1934 | Elstub | 451/268 |
| 2,328,809 | * | 9/1943 | Johnson | 451/262 X |
| 3,173,230 | * | 3/1965 | Bovensiepen | 451/9 |
| 3,225,492 | * | 12/1965 | Day et al. | 451/65 |
| 3,537,214 | * | 11/1970 | Ford | 451/262 |
| 3,618,265 | * | 11/1971 | Croop | 451/262 |
| 4,433,510 | * | 2/1984 | Katagirl et al. | 451/269 X |
| 4,805,348 | * | 2/1989 | Aria et al. | 451/269 |
| 5,333,413 | * | 8/1994 | Hashimoto | 451/9 |
| 5,762,543 | * | 6/1998 | Kasprzyk et al. | 451/262 |
| 5,782,678 | * | 7/1998 | Cesna et al. | 451/269 |

* cited by examiner

*Primary Examiner*—Timothy V. Eley
(74) *Attorney, Agent, or Firm*—Snell & Wilmer, L.L.P.

(57) ABSTRACT

A set of supports are advantageously disposed on a top plate having a polishing surface useful for polishing workpieces, thereby applying substantially uniform pressure to the top plate. In a preferred embodiment, the supports are non-isosceles triangular elements distributed evenly at 45 degree increments around a ring-shaped top plate. This structure effectively compensates for radial stress variations arising from non-optimum positioning of support points with respect to the inner and outer diameters of the polishing surface.

12 Claims, 4 Drawing Sheets

APPARATUS FOR POLISHING USING IMPROVED PLATE SUPPORTS

TECHNICAL FIELD

The present invention relates, generally, to techniques for polishing workpieces and, more particularly, to the use of improved plate support structures to increase pressure uniformity at the workpiece surface.

BACKGROUND ART AND TECHNICAL PROBLEMS

Polishing technology has been largely driven by the need for exceptionally smooth and planarized surfaces on high-tech materials and components such as magnetic disks, semiconductors, and the like. In the case of semiconductor wafers, for example, polishing techniques are employed not just for polishing and planarizing the bulk wafer, but also for planarization of those layers which comprise the active circuitry; e.g., conductor metals, passivation, and inter-layer dielectrics.

In a paradigmatic polishing operation, a platen/polishing-pad assembly is employed in conjunction with a slurry, for example a water-based slurry comprising colloidal silica particles. When pressure is applied between the polishing pad (e.g., a polyurethane pad) and the workpiece being polished, mechanical stresses are imparted to the workpiece surface. Abrasive particles within the slurry act to create zones of localized stress, which in turn creates mechanical strain on the chemical bonds comprising the surface being polished. Consequently, microscopic regions are removed from the surface being polished, enhancing planarity of the polished surface.

Furthermore, in a chemical-mechanical planarization context (CMP), the slurry is used to effect chemical as well as mechanical polishing and planarization. More particularly, the slurry suitably comprises a chemically and mechanically active solution, for example, abrasive particles coupled with chemically reactive agents. Suitable chemically reactive agents include hydroxides, but may also include highly basic or highly acidic ions.

See, for example, Arai, et al. U.S. Pat. No. 5,099,614, issued March, 1992; Karlsrud, U.S. Pat. No. 5,498,196, issued March, 1996; Arai, et al., U.S. Pat. No. 4,805,348, issued February, 1989; Karlsrud et al., U.S. Pat. No. 5,329,732, issued July, 1994; and Karlsrud et al., U.S. Pat. No. 5,498,199, issued March, 1996, for further discussion of presently known lapping and planarization techniques. By this reference, the entire disclosures of the foregoing patents are hereby incorporated herein.

A key variable used to characterize a particular polishing or grinding process is the material removal rate. The material removal rate of a process is simply the rate at which material is removed from the workpiece surface, and is typically expressed as a length per unit time (e.g., microns per minute).

Many factors can and do affect material removal rate. For example, the material properties of the polishing surface, the mechanical and chemical properties of the slurry, and the properties of the workpiece surface itself are all important factors. In addition, and more important for the purposes of the present invention, removal rate is a strong function of applied pressure. That is, removal rate increases as the local normal compressive force applied to the workpiece surface increases.

Presently known polishing/grinding techniques are unsatisfactory in several regards. In many polishing configurations, for example, particularly those where processing of multiple or large workpieces is performed, material removal rate can vary significantly from workpiece-to-workpiece and across individual workpieces themselves due to uneven force distribution at the workpieces. More particularly, polishing, of multiple workpieces is often performed using a large ring-shaped top plate. When such a plate is supported at points substantially close to the inner or outer diameters, or otherwise supported non-optimally, the compressive force varies radially; that is, the ring in the vicinity of the support points is rigidly supported and hence will necessarily exhibit less deflection and impart a greater downward force than will those regions of the ring which lack a rigid support.

Presently known techniques are also unsatisfactory in that, due to manufacturing limitations, polishing plates often exhibit minor non-planarities. It is common for such plates to be either concave or convex in shape (for example, 10 micron profile variation over a span of 24 inches is not uncommon), and even minor variations in plate planarity can have a significant impact on applied stress at the workpiece surface. These non-planarities are exacerbated by the support techniques mentioned earlier. When a non-planar ring is supported, for example, by a series of posts near the inner diameter, it is possible that deflection of the ring during processing will work to increase the overall non-planarity of the polishing surface.

Chemical mechanical planarization techniques are thus needed which reduce variation in material removal rates resulting from force variations across the polishing surface introduced as a result of non-optimum plate supports.

SUMMARY OF THE INVENTION

In accordance with the present invention, a set of plate supports are advantageously disposed between a backing plate and a top plate having a polishing surface useful for polishing workpieces, thereby producing a substantially uniform material removal rate. In a preferred exemplary embodiment, a structure useful in the context of the present invention suitably comprises a non-isosceles triangular element. In a particularly preferred embodiment, a set of eight such structures are distributed evenly at 45 degree increments around a ring-shaped top plate.

In accordance with one aspect of the present invention, a preferred support reduces radial stress variations arising from non-optimum positioning of support points with respect to the inner and outer diameters of the polishing surface.

In accordance with another aspect of the present invention, a preferred support reduces radial stress variations arising from the effects of increasing applied pressure; that is, the stress distribution at the workpiece surface remains substantially constant as applied pressure is increased.

BRIEF DESCRIPTION OF THE DRAWING FIGURES

The subject invention will hereinafter be described in conjunction with the appended drawing figures, wherein like numerals designate like elements, and:

DETAILED DESCRIPTION OF PREFERRED EXEMPLARS EMBODIMENTS

Figure 1:
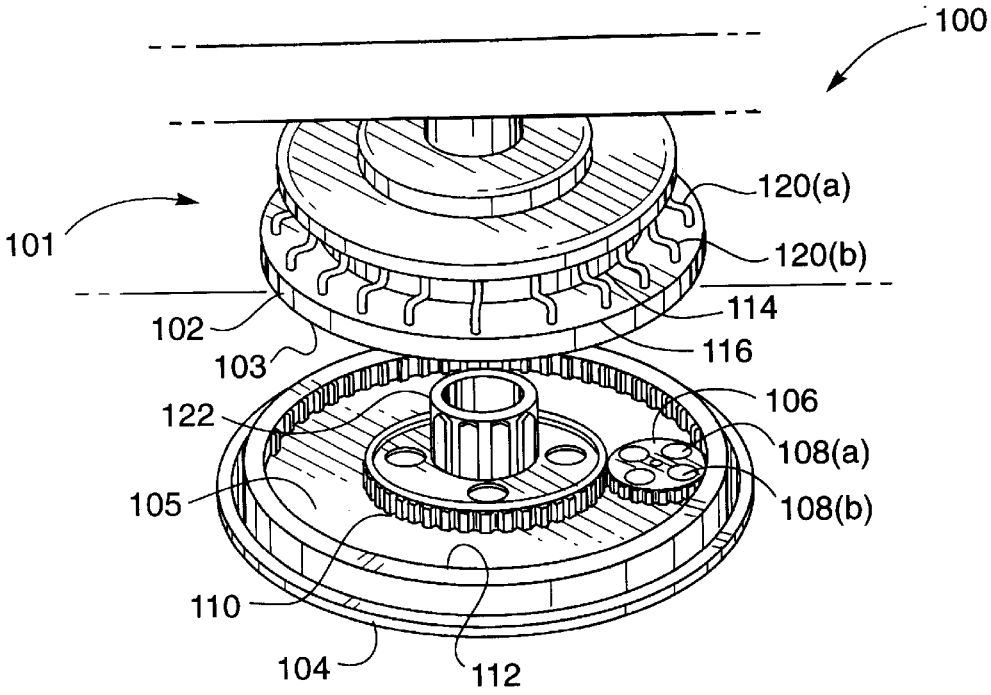
FIG. 1 is an illustration showing an exemplary double-side polishing apparatus.

With reference to FIG. 1, an exemplary polishing apparatus 100 useful in illustrating the present invention will now be described. As a preliminary matter, the terms "polishing" and "polisher" as used herein embrace a wide range of both wet and dry planarization techniques, for example chemical-mechanical polishing, lapping, grinding honing slurry polishing, and chemical-mechanical planarization (CMP). As the primary goal of the present invention is to enhance material removal rate uniformity by providing substantially equal pressure over a workpiece or workpieces, the present invention may be advantageously employed in a variety of such contexts.

An exemplary double-side polishing apparatus 100 useful in illustrating the present invention comprises a top plate 102, a plurality of slurry supply lines 120, a bottom plate 104, and a carrier 106 for housing at least one workpiece 108. The bottom surface (not shown) of top plate 202 and the top surface of bottom plate 104 comprise a suitable polishing material, thereby forming polishing surfaces 103 and 105 respectively. Polishing materials suitable for use with the present invention include, for example, polyurethane pads, honing stones, and the like.

Carrier 106 may suitably be configured such that both the top and bottom surfaces of workpieces 108 are exposed, that is, the carrier itself contacts workpieces 108 only along their outer edges, allowing both the top and bottom surfaces of workpieces 108 to be polished simultaneously.

Surface 105 of bottom plate 104 is bordered by inner ring 110 and outer ring 112. Carrier 106 is situated between and preferably in contact with both rings 110 and 112. Rings 110 and 112 are suitably provided with gear teeth which mesh with comparable teeth disposed along the circumference of carrier 106. Alternatively rings 110 and 112 may suitably be provided with pins serving the same purpose. In either case, rings 110 and 112 are typically referred to as the "sun gear" and "planetary gear" respectively. It will be appreciated that this configuration allows significant flexibility in choosing carrier movement; that is, by altering the direction and angular velocity of rings 110 and 112 (which are suitably independent), the orbital path of carrier 106 may be precisely specified.

Top plate 102 is preferably configured such that during polishing, it seats within the region defined between rings 110 and 112. Specifically, top plate 102 is preferably ring-shaped, wherein its inner and outer diameters (ID 114 and OD 116) substantially correspond to inner ring 110 and outer ring 112 respectively.

During operation, top plate 102 may be lowered vertically such that polishing surface 103 makes contact with the top surface of workpieces 108 in carrier 106. Driver 122 provides rotation of plate 102 by meshing with keys provided on the underside (not shown) of top assembly 101. Pressure is provided at the interface of workpieces 108 and polishing surface 103 by virtue of the weight of top plate 102 and other contiguous assembly elements. That is, the weight of top assembly 101 supplies any downward force required for polishing.

Figure 2:
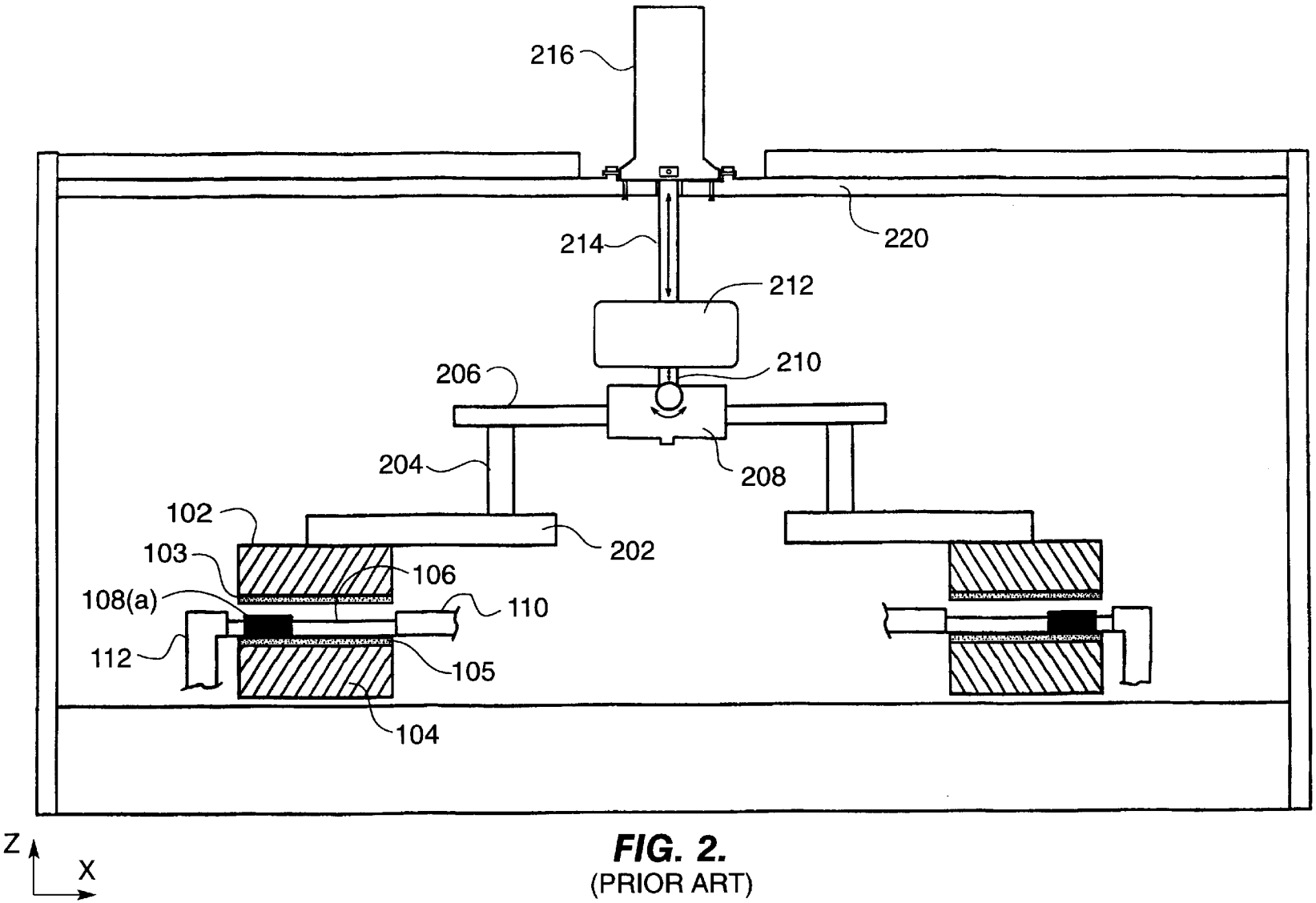
FIG. 2. (PRIOR ART)
FIG. 2 is a schematic drawing showing a simplified cross-section view of a typical prior art polishing apparatus.
Figure 3A:
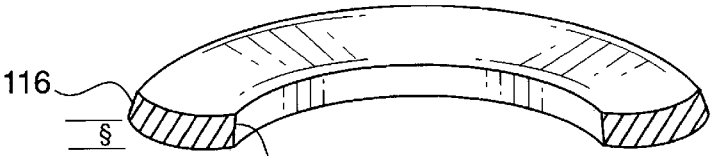
FIG. 3(a) (PRIOR ART)
FIG. 3A shows a partial perspective view of a prior art polishing plate.
Figure 3C:
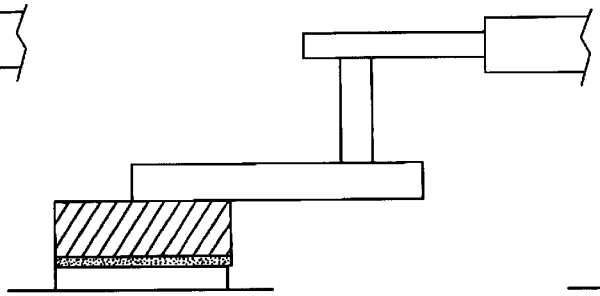
FIG. 3(c) (PRIOR ART)
FIG. 3C is a schematic close-up of a typical prior art polishing plate/support structure, showing variations in force distribution as polishing progresses.
Figure 3D:
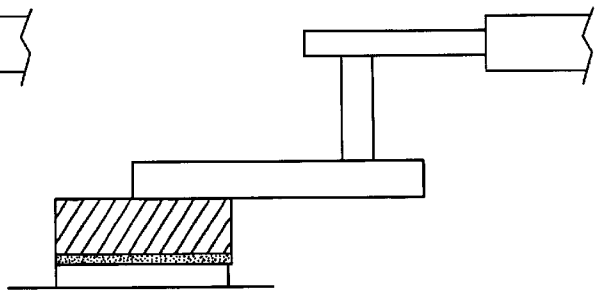
FIG. 3(d) (PRIOR ART)
FIG. 3D is a schematic close-up of a typical prior art polishing plate/support structure, showing variations in force distribution as polishing further progresses.
Figure 3B:
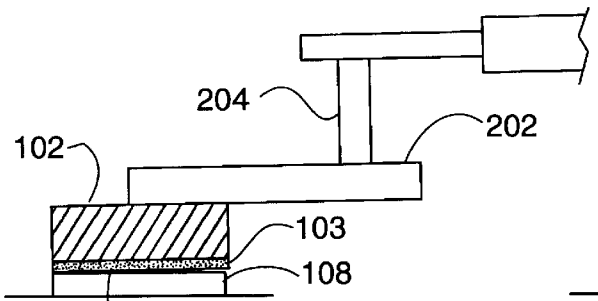
FIG. 3(b) (PRIOR ART)
FIG. 3B is a schematic close-up of a typical prior art polishing plate/support structure, showing variations in force distribution as polishing begins.

More particularly, and with reference to an exemplary prior art polishing system as illustrated in FIG. 2, plate 102 is typically secured by a ring-shaped backing plate 202, which is attached via supports 204 to plate 206. It will be appreciated that FIG. 2 presents a simplified model, wherein certain details of the polishing apparatus are left out for purposes of clarity, most notably plate driver 122 and slurry supply lines 120 (shown in FIG. 1).

With continued reference to FIG. 2, plate 206 is attached to gimbal 208, which allows free rotation of plate 206 about its central axis while at the same time allowing a limited rocking movement of the top assembly "top assembly" in this context refers to plate 206, supports 204, plate 202, and plate 102). It will be appreciated that the increased decrees of freedom provided by gimble 208 allow for more uniform distribution of stresses on polishing surface 103 during processing.

Gimbal 208 is attached by a short shaft 210 disposed within subcylinder 212. Shaft 214, attached to the top of subcylinder 212, is disposed within main cylinder 216. Consequently, the vertical translation of top plate 102 is controlled by the movement of shaft 214 within main cylinder 216 and shaft 210 within subcylinder 212. This movement is suitably controlled by computer controlled pneumatic actuators.

Because the downward force exerted during polishing is suitably dependant on the extent to which the weight of the top assembly is permitted to rest on workpieces 108, polishing force is modulated by changing the upward force applied along shaft 210 by subcylinder 212. For example, it is conceivable that the full weight of the top assembly may be applied to workpieces 108 during polishing. In practice however due to the significant weight of such systems doing so would typically result in excessive force. Thus, optimum polishing pressure in any particular case is achieved by balancing gravitational forces on the top assembly with the upward force along shaft 214.

It will be appreciated that the attachment of support 204 well within the inner diameter of plate 102, as shown, results in "sagging" of ring 202 and plate 102 due to a lack of rigidity at the outer diameter portions. When plate 102 is hanging free (i.e., not yet contacting workpiece 108) and subject to its own weight the outer diameter of plate 102 will be slightly lower than the inner diameter. To offset this tendency, such plates are often manufactured with a compensating pre-warp. Specifically and with reference to FIG. 3(*a*), plates are often machined such that their unstressed shape (i.e., the shape the plate would exhibit without weil (ht-induced deformation) is characterized by an upward turn near the outer diameter 116. Notwithstanding this pre-warping, however, it is still common for such plates to hang lower near the outer diameter than the inner diameter, since the machining does not typically account for deformation of ring 202 and other structural features of the assembly.

In this regard. FIG. 3(*b*) shows a close-up of a typical prior art plate support structure. For simplicity, carrier 106 and workpieces 108 as shown in FIG. 2 are represented by a single exemplary workpiece 108. When plate 102 is lowered onto workpiece 108, polishing surface 103 first makes contact in an area 302 near the outer diameter of the workpiece. Consequently, the stress distribution is skewed toward the outer diameter as depicted qualitatively by arrows 304.

As plate 306 is lowered further, and the overall pressure on workpiece 108 increases, the pressure distribution will, depending on the precise contours of plate 102, shift toward the center ot plate 102 as shown in FIG. 3(*c*) and depicted by arrows 306. That is, the effects of pre-warping give rise to a slight decrease in pressure toward the outer diameter as the force on plate 102 is spread over a larger area.

As plate 102 is lowered further, the effects of pre-warping, become more pronounced, and the weight of ring 202 and other parts of the upper assembly bear down more along the inner diameter. This results in a skewed pressure distribution as indicated by arrows 308.

In a simpler case, where no pre-warping of plate 102 is performed, it will be appreciated that the pressure distribution on workpiece 108 will similarly shift as applied pressure is increased. Although the stress on the outer diameter will not benefit from the effects of pre-warping, the stress will nevertheless shift toward the inner diameter due to the non-optimal placement of supports 204 with respect to ring 202 and plate 102.

Figure 4:
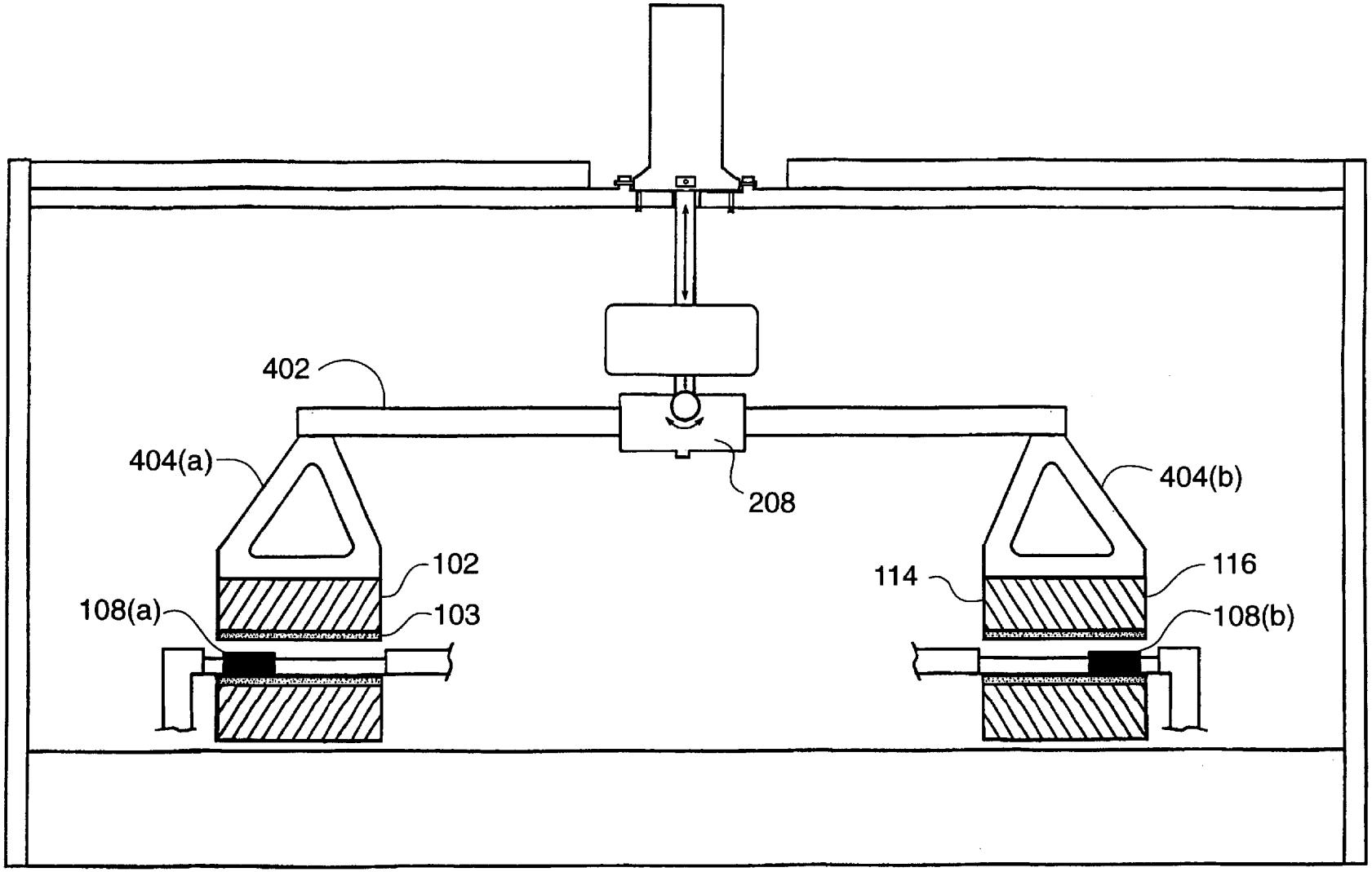
FIG. 4 is a cross-section view of an exemplary plate and support structure in accordance a preferred embodiment of the present invention.

Referring now to FIG. 4, an improved support structure for plate 102 in accordance with a preferred embodiment of the present invention will now be described in detail. A plurality of supports 404 are interposed between backing plate 402 and polishing plate 102 such that a substantially uniform force distribution results at the interface of surface 103 and workpieces 108 during processing. Backing plate 402 is preferably rigidly attached to gimbal 208. In a particularly preferred embodiment, eight such supports 404 are uniformly distributed at 45 degree increments around the top of plate 102.

Preferably, supports 404 are substantially rigid, preventing, deformation of plate 102 due to its own weight and more evenly distributing applied force during polishing. Thus, the shape of supports 404 is chosen to compensate for variations discussed in detail above. Those skilled in the art will appreciate that it is not necessary for supports 404 to be precisely triangular as shown in FIG. 4; it is only necessary that they be functionally triangular—i.e., that any vertical force acting between backing plate 402 and polishing plate 102 through supports 404 is distributed radially over a larger area defined by the width of plate 102.

In a particularly preferred embodiment, supports 404 have a non-isosceles triangular shape, wherein the top vertex of each support (i.e., the point at which each support 404 is affixed to backing plate 402) has a radial axis coordinate closer to ID 114 than to OD 116. Finite element analysis and empirical results suggest this to be a preferred configuration.

Figure 5A:
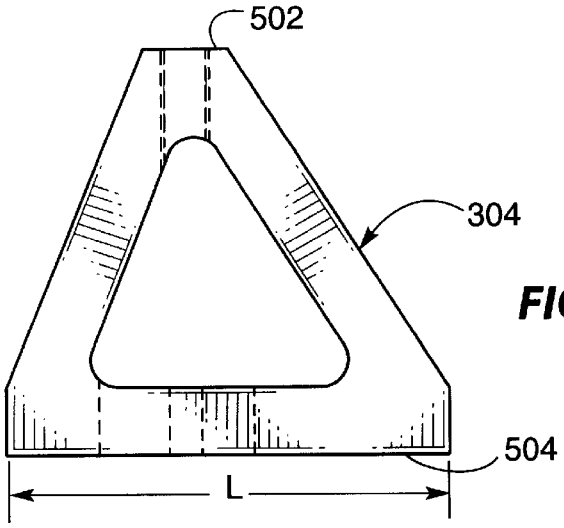
FIG. 5A depicts an exemplary support in accordance with a preferred embodiment of the present invention, showing a front view.
Figure 5B:
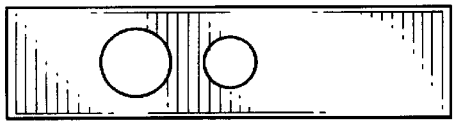
FIG. 5B depicts an exemplary support in accordance with a preferred embodiment of the present invention, showing a side view.

FIG. 5 depicts scaled drawings of a support 304 in accordance with a preferred embodiment of the present invention. The illustrated configuration is particularly suited to a scenario wherein the inner diameter of plate 102 is approximately 80–100 cm, preferably 90 cm, and the outer diameter is approximately 120–140 cm, preferably 130 cm. In this scaled figures, top and side views (FIGS. 5(*a*) and 5(*b*) respectively) of a preferred support are shown, and the reference dimension L is approximately 180–220 mill preferably about 200 mm.

Support 404 is preferably constructed from a suitably rigid material, for example, '304' stainless steel, and is preferably secured to a backing plate 402 at top 502 and secured to plate 102 along the full length L of bottom 504.

Although the present invention is set forth herein in the context of the appended drawing figures, it should be appreciated that the invention is not limited to the specific forms shown. Various other modifications, variations, and enhancements in the design and arrangement of the support structures and various design parameters discussed herein may be made in the context of the present invention. For example, while the present invention is described in the context of an exemplary double-side polishing apparatus, it will be appreciated that many other polishing configurations would benefit from such a stabilizing apparatus, particularly where a large circular plate is used for polishing large or multiple workpieces. Similarly, the present invention was described in the context or "polishing", it will be appreciated that tile present invention may advantageously be employed for grinding, honing, chemical-mechanical polishing, lapping, and other such abrasive operations.

These and other modifications may be made in the design and implementation of various aspects of tile inven1tioll without departing from the spirit and scope of the invention as set forth in the appended claims.

What is claimed is:

1. An apparatus for polishing at least one workpiece, said apparatus comprising:

a top plate having a bottom surface and a top surface;

a first polishing surface provided on said bottom surface of said top plate for planarizing said at least one workpiece, wherein said first polishing surface exerts a downward force on said workpiece, and said workpiece experiences a material removal rate; and a plurality of support means secured to said top surface of said top plate for distributing said downward force such that variation of said material removal rate across said at least one workpiece surface is substantially independent of said downward force.

2. An apparatus as in claim 1, wherein:

said top plate has an inner and an outer diameter; and said support means comprises a substantially rigid structure secured to said top surface of said top plate from said inner diameter to said outer diameter.

3. An apparatus as in claim 2, wherein said substantially rigid structure is substantially triangular.

4. An apparatus as in claim 2, wherein:

said plurality of support means comprises eight said substantially rigid structures distributed at 45 degree increments around said top surface of said top plate; and said substantially rigid structure is substantially triangular.

5. An apparatus as in claim 3, wherein said substantially rigid structure is a non-isosceles triangle.

6. An apparatus as in claim 3 wherein:

said substantially rigid structure has a top vertex; and said top vertex is substantially closer to said inner diameter of said top plate than to said outer diameter of said top plate.

7. An apparatus for polishing at least one workpiece, said apparatus comprising:

a top plate having a bottom surface and a top surface;

a first polishing surface provided on said bottom surface of said top plate for planarizing said at least one workpiece wherein said first polishing surface exerts a downward force on said workpiece, and said workpiece experiences a material removal rate;

a backing plate having a bottom surface; and a plurality of support means interposed between said top surface of said top plate and said bottom surface of said backing plate for distributing said downward force such that variation of said material removal rate across said at least one workpiece surface is substantially independent of said applied force.

8. An apparatus as in claim 7, wherein said top plate has an inner and outer diameter, and said Support means comprises a substantially rigid structure secured to said top surface of said top plate from said inner diameter to said outer diameter.

9. An apparatus as in claim 8, wherein said substantially rigid structure is substantially triangular.

10. An apparatus as in claim 9, wherein said substantially rigid structure is a non-isosceles triangle.

11. An apparatus as in claim 9, wherein:

said substantially rigid structure has a top vertex; and said top vertex is substantially closer to said inner diameter of said top plate than to said outer diameter of said top plate.

12. An apparatus as in claim 8, wherein:

said plurality of support means comprises eight said substantially rigid structures distributed at 45 degree increments around said top surface of said top plate; and said substantially rigid structure is substantially triangular.

* * * * *